US006202709B1

(12) United States Patent
Wymer

(10) Patent No.: US 6,202,709 B1
(45) Date of Patent: Mar. 20, 2001

(54) BAR GRABBER

(76) Inventor: William J. Wymer, 12905 Tikiwood Ct., Riverview, FL (US) 33569

( * ) Notice: Subject to any disclaimer, the term of this patent is extended or adjusted under 35 U.S.C. 154(b) by 0 days.

(21) Appl. No.: 09/379,845

(22) Filed: Aug. 24, 1999

(51) Int. Cl.[7] ..... B65B 67/00

(52) U.S. Cl. ..... 141/10; 141/390; 141/391; 141/316; 248/97; 248/99

(58) Field of Search ..... 141/10, 316, 390, 141/391; 248/97, 99

(56) References Cited

U.S. PATENT DOCUMENTS

| | | | | |
|---|---|---|---|---|
| 3,532,314 | * | 10/1970 | Vosbikian | 348/97 |
| 4,026,340 | * | 5/1977 | Sobolik | 150/48 |
| 4,287,701 | * | 9/1981 | Washington | 248/99 |
| 4,312,489 | * | 1/1982 | Paetzold | 248/97 |
| 4,319,726 | * | 3/1982 | Andersson | 248/97 |
| 4,708,307 | * | 11/1987 | Daigle | 248/97 |
| 5,082,219 | * | 1/1992 | Blair | 248/99 |
| 5,139,219 | * | 8/1992 | Navarro | 248/97 |
| 5,183,227 | * | 2/1993 | Wilhite | 248/99 |
| 5,588,922 | * | 12/1996 | Gordon, Sr. | 248/99 |
| 5,735,494 | * | 4/1998 | Kurk | 248/97 |
| 5,743,651 | * | 4/1998 | Steinmetz | 248/98 |

* cited by examiner

*Primary Examiner*—J. Casimer Jacyna

(57) ABSTRACT

The present invention is a bag holder for plastic bags for use in lawns, gardens and the Like. A method and trash bag assembly for collecting lawn clippings, fallen leaves, and Trash when doing yard work and filling trash bags.

5 Claims, 3 Drawing Sheets

BAR GRABBER

BACKGROUND OF THE INVENTION

1. Field of the Invention

This invention relates to doing yard work around the house and more particularly concerns a method and apparatus for collecting fallen leaves, lawn clippings and trash when doing yard work and inserting such material into a trash bag which is fully open without being required to stand there and hold it open.

2. Description of the Prior Art

Anyone who has done yard work around their home is familiar with plastic trash bags. These bags are generally made from film ranging from 0.5 to 1.2 mil thickness. The common types available differ somewhat in diameter and length, but not by much. They are advertised as fitting into garbage cans up to thirty gallons, thirty-three gallons or thirty-nine gallons.

These bags are very handy and economical. The problem arises when it comes to filling them. An accepted technique is to place the open bag into a metal or plastic garbage can and fold the lip of the bag over the top edge of the can. This assumes that a can is available, the can is empty, and it is the correct shape to suit the bag.

Under ideal conditions, the bag in the can accepts leaves, grass clippings, pine needles, or whatever, without falling into the can with the trash. Once the bag is full; it must be lifted from the can. According to U.S. Pat. No. 4,558,463, which issued on Dec. 10, 1985, to Boyd, "The load in a trash bag may typically be as high as 30–50 lbs." Column 1, lines 21–22.

To lift that weight itself not easy, but to add to the difficulty the lower portion of the bag is swelling and gripping the can like a cork in a bottle. Now the can, must be held down while the full bag is drawn out.

To fill a trash bag without using a can as an assist is also very difficult. It is almost impossible to lay a bag on the ground and arrange the opening to anywhere near its full extent. Bags having a hem top edge with a drawstring are somewhat better in this regard than bags with a simple sheared edge, but even the hemmed bags leave much to be desired.

As the prior art of making a bag opener includes some of the following references; In cases where elongated curved sheets of Williams (U.S. Pat. No. 5,183,339) of February 1993 and the double rings of Sobolik (U.S. Pat. No. 4,026,340) of May 1997, also the use of a stand and clamping devices of Navarro (U.S. Pat. No. 5,139,219) of August 1992 and the weaving of rod Steinmetz (U.S. Pat. No. 5,743,651) of April 1998, as well as Blair (U.S. Pat. No. 5,082,219) of January 1992, Hayes (U.S. Pat. No. 5,011,103) of April 1991, Boyd (U.S. Pat. No. 4,558,463) of December 1985, Washington (U.S. Pat. No. 4,287,701) of September 1981.

While all the above show advantages in the art of keeping bags open and allowing a person to fill them, there appears to be none as flexible and have the multiple quick locking attachment to a portable post as well as the given ability to form the shape when put to the ground to allow a person to rake directly into the bag being held opened and have the flexibility to instantly return to its circular shape when pressure applied to form the wide opening is released, as the invention being filed for herein.

SUMMARY OF THE INVENTION

My inventive method and apparatus is intended to alleviate the foregoing problems. It includes a reusable flexible band with a handle attached; the invention is placed over the end of a plastic bag at the bags open end. As the bag edges are pulled over the band of the invention all the way around, it forms a circular opening in the bag, thus leaving the bag open to be filled.

When placed on the ground with the opening In a vertical position one can press down on the top of the invention and cause the opening to take a wide oval shape that allows a person to rake into the bag; as opposed to picking up and putting in the bag. The invention also allows the use of the opened bag to be filled by picking up and putting trash into bag if so desired using only one hand to perform the task of holding the bag.

While this invention may be used by itself or with the adjustable handle-locking device and post. The post is inserted into the ground by means of applying pressure to the foot tab attached to the post, sliding the adjustable handle locking device over the post to the desired height to accommodate the bag length. By attaching the handle of the invention onto the adjustable handle locking device it holds the plastic bag upright and open, with the bottom of the bag supported by the ground. As the bag fills, lowering the invention by means of the adjustable handle-locking device will keep the bag open while letting the ground support the weight thereof.

The invention may be made from one of many materials, such as plastic, metal or perhaps even wood. What I found that worked best for me was a plastic polycarbonate, it seamed to me to be the best because of its strength and memory. Once formed into a circle it will return instantly to that shape when depressed and released again. I used a strip of this polycarbonate plastic approximately one and one half inch wide by one eight inch thick and made the length sixty one and a half inches long. The handle is made of the same material, in the size of four inches by six inches, by attaching the two ends of the strip to the handle using a product for joining acrylic called, weld-on #16, made by I.P.S. corp, I had the desired invention. In the handle a cut out was made to allow a person to insert a hand into, at the same time an adjustable handle locking device was designed to match the cut out of the handle. The locking device is L shaped with a hole large enough to slide over the accommodating post, yet tight enough to lock when the weight of the handle causes it tilt. For the larger lawn bag, 39 gallon, I made the band length sixty nine inches. I made this even though the shorter band will work on larger bags.

The bag opener is flexible and can be turned inside out by twisting, taking the handle in one hand and the opposite side of the band in the other hand and twisting. This twisting also allows the invention to accommodate larger bags. The wide band of the invention, grabs the plastic bag when the ends are pulled over the band such as one would fold the edges over the mouth of a trash can, also larger bags can be used by this invention.

Insert the open end of a trash bag through the center of the invention and pull the edges over the band, just as one would for a smaller bag; then give the invention a twist and the bag edges will roll up onto the band and stay in place the bag is ready to be filled.

The band and handle combined form a circle of a diameter approximately equal to the diameter of an average trash bag. The invention herein, unlike most, goes on the outside of the bag; thus, avoiding contact with trash if need be.

The supporting post with the adjustable handle locking device and foot anchoring tab is not intended to support the weight of the bag, but rather allow a person to lower the open mouth of the bag as it becomes fuller. This allows the ground to support the bottom of the bag thus taking the stress off of the invention and still allowing a person to fill the bag until full. The supporting post is not a necessary application and a person may use the bag opener with or without it.

The post may be of a variety of materials. I used plastic, and attached a tab near the bottom close to the pointed end and used the tab to push the post into the ground by means of using the foot and body weight.

DETAILED DESCRIPTION OF THE DRAWINGS

Figure 1:
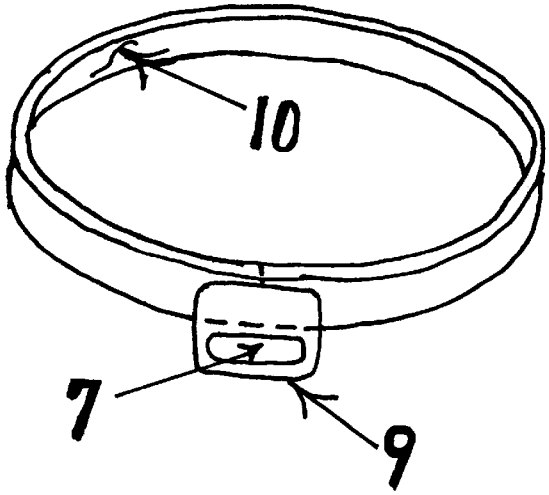
FIG. 1 is a view in perspective of bag apparatus constructed in accordance with this invention.
Figure 1A:
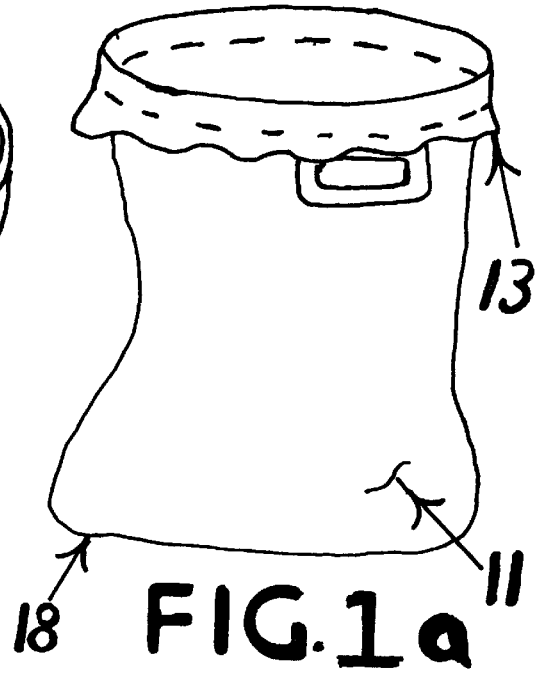
FIG 1*a* is a view of a bag with its top held fully open by the invention.

Turning now to the drawings, there is shown a trash bag (11) having a closed bottom portion (18) and a open top portion (13). A bag opener, flexible band (10) and handle (9) with a cutout (7). This provides for opening and holding open, the open end (13) of the trash bag (11) while it is being filled with trash material such as lawn clippings, fallen leaves and other trash. The bag (11) is inserted through the band (10) and the edges of the open bag end (13) are folded over the band (10) and handle (9) thus expanding the open top perimeter (13) of the bag (11) in a circular position so that bag (11) is fully opened to receive such material as fallen leaves, lawn clippings and the such, without requiring anyone to hold the bag open. The band (10) and handle (9) shown in FIG. 1 are combined to make one complete bag opener apparatus. The method of collecting trash material such as lawn clippings, fallen leaves and the such when doing yard work comprises the steps of taking a trash bag (11) having a closed bottom portion (18) and an open end top portion (13) inserting the bag (11) through the band (10) and folding the open top portion (13) over the band (10) and handle (9), (as one would over the open top of a trash can) to expand the open top portion (13) into a circular position and fully open the bag (11) opening (13). By leaving the band (10) and handle (9) in place by means of expanding the open end top perimeter (13) around band (10) and handle (9). Placing the bag on the ground with the fully open perimeter (13) standing in a vertical position with the handle (9) on top. By pressing down on the handle (9) causing the band (10) to flatten and form an wide oval shape, and allowing a person to rake trash fallen leaves and lawn clippings directly into the bag (11). Alternatively, by means of holding the bag (11) installed on the invention, band (10) and handle (9) taking the handle (9) in one hand while using the other hand to fill the bag (11). Another part that can be used with or without the bag opener is the portable post FIG. 4*b* and the adjustable handle locking device (22) of FIG. 3. The bag opener apparatus can be made free standing using the following steps, taking the adjustable hand locking device (22) and inserting it into the cut out (7) of handle (9) by means of inserting the edge (26) FIG. 3 of the locking device (22) into the cutout (7) of the handle (9) and inserting these coupled parts onto the post (20) by means of the hole (25) in the adjustable handle locking device (22) thus making the bag (11) installed onto the band (10) and handle (9) attached to the adjustable handle locking device (22) that is inserted onto post (20) that is anchored in the ground at the pointed end (23). The weight of the bag (11) and band (10) with handle (9) cause the adjustable locking device (22) to lock onto post (20) keeping the bag (11) open while the bottom closed portion (18) of the bag (11) rest on the ground FIG. 3*b* allowing the ground to support the weight of lawn clippings, fallen leaves and such trash that is put into the bag (11), as the bag (11) becomes fuller the bag opening (13) may be lowered by means of the adjustable hand locking device (22) allowing the ground to continue supporting the weight in the bag (11) until full. The post (20) of FIG. 4*b* is anchored into the ground by means of putting the pointed end (23) to the ground and putting ones foot onto the foot tab (21) and applying body weight to force the post (20) into the ground.

The band (10) and handle (9) may be used on the average trash bag and the larger lawn size such as the 39 gal size. The method to use on the larger size is the same, by inserting the bag (11) through the band (10) and folding the edges of the open portion (13) over the band (10) and handle (9) then by twisting the band (10) causing it to turn inside out, at the same time rolling the edges of the open portion (13) around the band (10) thus allowing larger size bags to be used.

Figure 2:
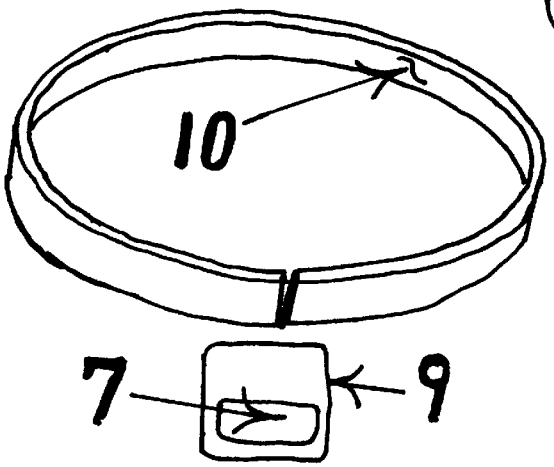
FIG. 2 is a view of the flexible band and handle, before assembly of the apparatus.
Figure 2A:
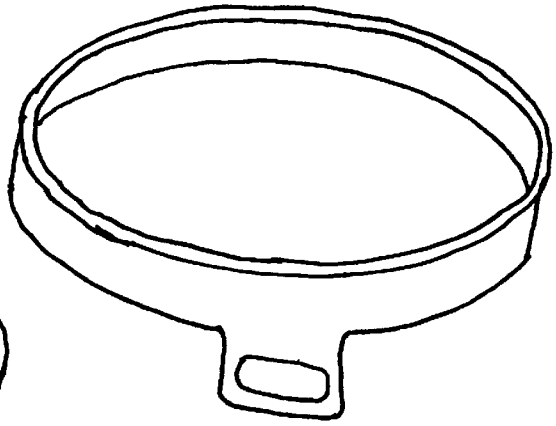
FIG. 2*a* is a view of another embodiment in a one, piece extruded form.
Figure 2B:
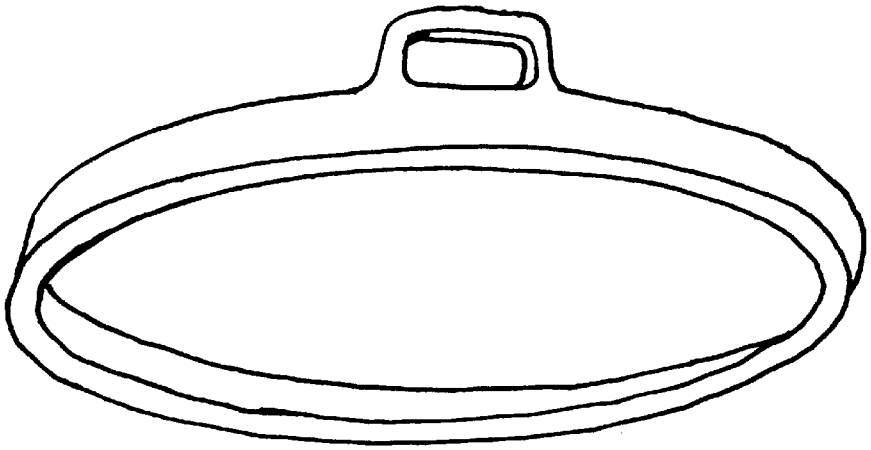
FIG. 2*b* is a view of the invention without a bag, to show the form it can take to make the wide oval mouth opening.

FIG. 2*b* is a view of the invention with the band (10) and handle (9) with cutout (7) forming the wide oval mouth as simulating someone pushing down on the handle, this view is shown without the bag (11) attached to revile more detail.

Figure 3:
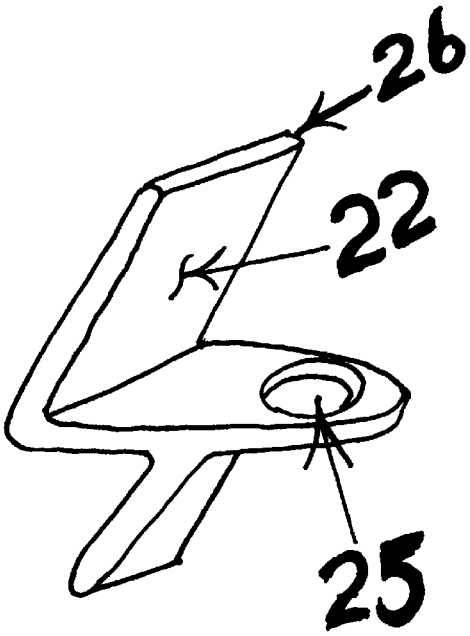
FIG. 3 is a view of the adjustably handle locking device.

FIG. 3 is a view of the adjustable handle locking device (22) with a hole (25) and an upper lip (26) and lower lip (27). The hole (25) is to allow the entrance of the post (20) and the upper lip (26) inserts into the cut out (7) of the handle (9) while the lower lip (27) rest against the handle (9).

Figure 3A:
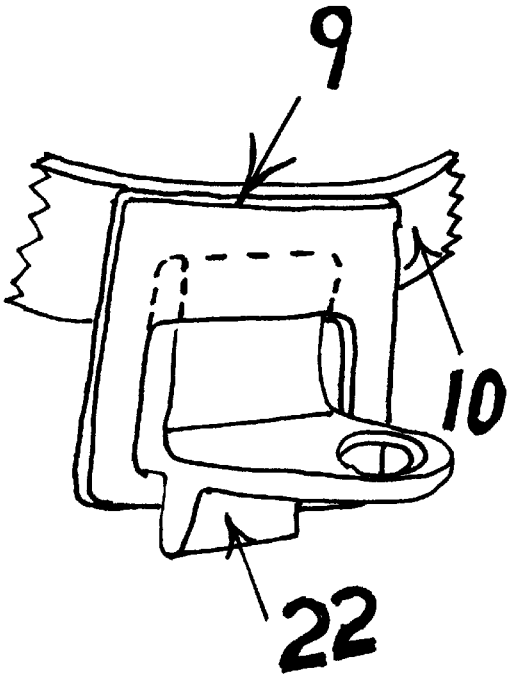
FIG. 3*a* is a view of the adjustable handle-locking device inserted into the handle of the bag opener apparatus.

FIG. 3*a* is a view of the adjustable hand-locking device inserted into the cutout (7) of the handle (9).

Figure 3B:
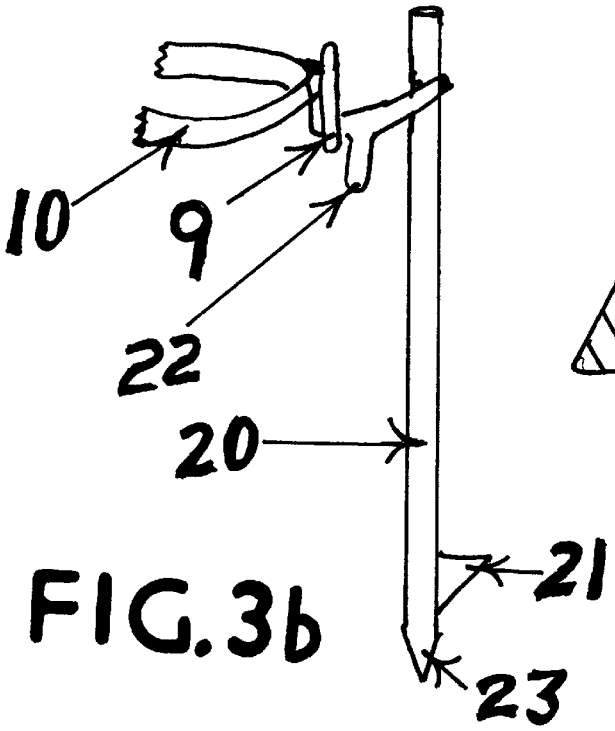
FIG. 3*b* is a view of the adjustable handle-locking device inserted into the bag apparatus and positioned onto the portable post.

FIG. 3*b* is a view of the bag (11) attached to band (10) and handle (9) locked onto post (20) by means of the adjustable handle locking device (22).

Figure 4:
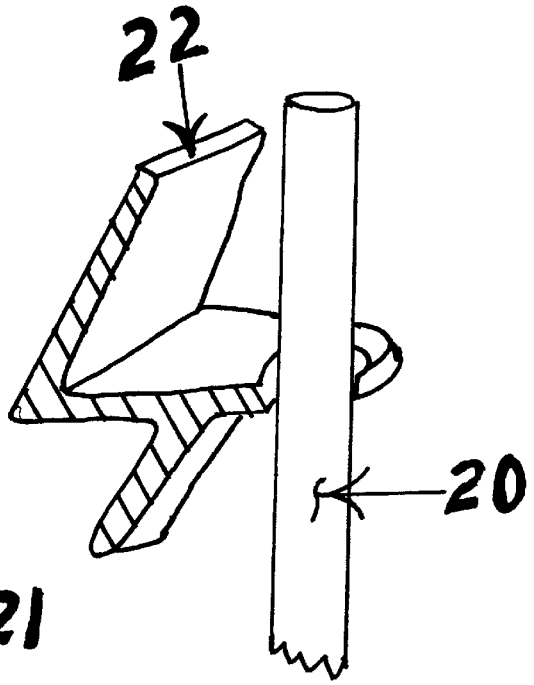
FIG. 4 is a cutaway view of the adjustable handle-locking device in the unlocked sliding position on the portable post.

FIG. 4 is a cutaway view showing the adjustable handle locking device (22) inserted onto post (20) in a position that allows the adjustable handle-locking device to be slid up or down the post (20).

Figure 4A:
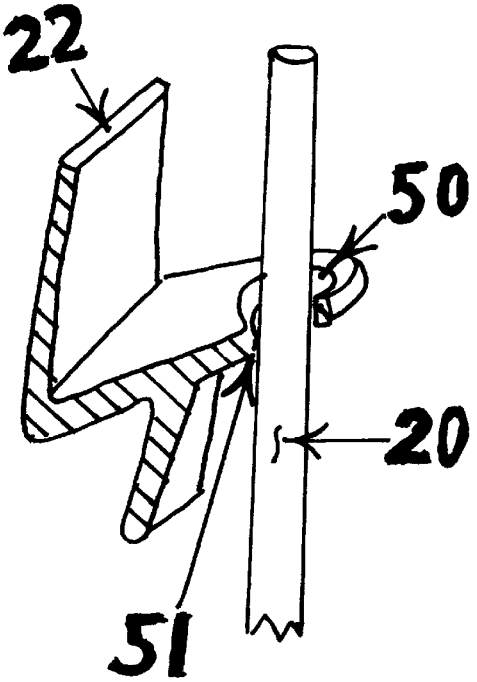
FIG. 4*a* is a cutaway view of the adjustable handle-locking device in the locked position on the portable post.
Figure 4B:
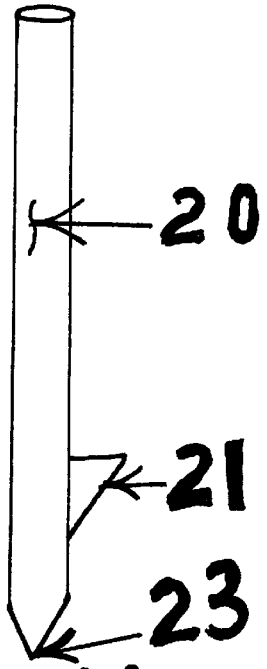
FIG. 4*b* is a view of the portable post.

FIG. 4*a* is a cutaway view showing the locking position of the adjustable handle locking device (22) on the post (20), showing the locking technique at points (50) and (51).

The invention having been described, what is claimed is:

1. A method of collecting lawn clippings, trash and fallen leaves comprising:

providing a bag with a closed end bottom portion and an open end top perimeter; providing a circular, stretchable, flexible band with a handle having a cut out for insertion of user's hand;

Providing an adjustable handle-locking device with a hole and a handle attaching end; providing a post with a pointed end, a flat end and a foot tab;

Putting the pointed end of the post to the ground and pushing down on the foot tab to anchor the post to the ground; sliding the adjustable handle locking device over the post by using the hole;

Inserting the open-end perimeter through the inside of the flexible band, then pulling the edges of the open end perimeter through the inside of the flexible band and then over the outside of the flexible band;

Attaching the band handle to the adjustable locking device by inserting the attaching end of the locking device through the cut of the handle; adjusting the height of the handle and adjusting the locking device onto the post thus suspending the bag in a freestanding upright position.

2. A method of collecting, as set forth in claim 1, including an adjustable handle self-locking device to engage said support pole. To retain said flexible band in position about said pole.

3. A method of collecting, as set forth in claim 2, wherein said support pole comprising of one section, whereby said pole need not be assembled facilitating convenient use and easy storage.

4. A method of collecting, as set forth in claim 3, wherein said support pole includes a laterally extending ledge adjacent said pointed end to enable a person to step thereon to aide in inserting said support pole into ground.

5. A method of collecting, as set forth in claim 1, wherein inserting the open end perimeter through the inside of the flexible band, then pulling the edges of the open end perimeter through the inside of the flexible band, pulling the edges of the open end perimeter over the outside of the flexible band, placing the flexible band to the ground in a vertical position and applying pressure to the top of said band, wherein an oval opening is formed at the open end perimeter.

* * * * *

UNITED STATES PATENT AND TRADEMARK OFFICE

CERTIFICATE OF CORRECTION

PATENT NO. : 6,202,709 B1
DATED : March 20, 2001
INVENTOR(S) : William J. Wymer

It is certified that error appears in the above-identified patent and that said Letters Patent is hereby corrected as shown below:

Title page,
Item [54] BAR-GRABBER should read -- BAG GRABBER --.

Signed and Sealed this

Twentieth Day of November, 2001

*Attest:*

Nicholas P. Godici

NICHOLAS P. GODICI

*Attesting Officer*

*Acting Director of the United States Patent and Trademark Office*